United States Patent [19]

Fink et al.

[11] Patent Number: 4,689,264

[45] Date of Patent: Aug. 25, 1987

[54] BOUND TEXTILE SHEET AND PROCEDURE FOR ITS MANUFACTURE

[75] Inventors: Herbert Fink, Bickenbach; Klaus Hübner, Ramstadt; Heiner Kniese, Seeheim-Jugenheim, all of Fed. Rep. of Germany

[73] Assignee: Rohm GmbH Chemische Fabrik, Darmstadt, Fed. Rep. of Germany

[21] Appl. No.: 830,507

[22] Filed: Feb. 11, 1986

[30] Foreign Application Priority Data

Feb. 28, 1985 [DE] Fed. Rep. of Germany ..... 3507154

[51] Int. Cl.[4] ..... B32B 27/00

[52] U.S. Cl. ..... 428/290; 428/254; 428/260; 428/272; 428/913; 428/265; 428/267

[58] Field of Search ..... 428/289, 290, 260, 272, 428/253, 254, 265, 267

[56] References Cited

U.S. PATENT DOCUMENTS 4,289,676 9/1981 Czauderna et al. ..... 260/29.6 H 4,476,182 10/1984 Fink et al. ..... 428/265

FOREIGN PATENT DOCUMENTS 0096230 12/1983 European Pat. Off. .

*Primary Examiner*—James J. Bell

*Attorney, Agent, or Firm*—Oblon, Fisher, Spivak, McClelland & Maier

[57] ABSTRACT

A method for the manufacture of bound textile sheets, comprising treating a textile sheet substrate with a water dispersion of a mixed polymerizate binder of: (a) 80–99% by wt. of a $C_{1-8}$ alkyl ester of acrylic acid, a $C_{1-8}$ alkyl ester of methacrylic acid, or combination thereof, or a mixture of at least one of said acrylate or methacrylate esters with styrene, (b) 1–10% by wt. of an acrylamide glycolic acid monomer of the formula:

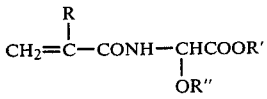

wherein R is hydrogen or methyl, R′ is alkyl and R″ is hydrogen or alkyl, and (c) 0–20% by wt. of another comonomer.

20 Claims, No Drawings

BOUND TEXTILE SHEET AND PROCEDURE FOR ITS MANUFACTURE

BACKGROUND OF THE INVENTION

1. Field of the Invention

The present invention relates to a procedure for the manufacture of bound textile sheets by introduction of an acrylic resin dispersion free of formaldehyde and of substances yielding formaldehyde. In addition, the invention relates to textile sheets manufactured by this process.

2.Description of the Background

Bound textile sheets have been manufactured in the past which exhibit outstanding wet tensile strength and fastness in water and to washing with lye. During manufacture, textile sheets are treated with aqueous acrylic resin dispersions, the synthetic resin component of which contain cross-linking amido-methylol groups. When the treated textile sheets area is dried, small quantities of formaldehyde are normally liberated, which formaldehyde raises health-related problems. Because of the objectionable release of formaldehyde, binders for textile sheets have been sought which have wet tensile strength and fastness to water and washing lye sufficient for practical purposes, but which do not yield formaldehyde when heated.

German Pat. No. 3,202,122 discloses a method of fixing the fiber structure in a sheet by treating the sheet with formaldehyde-free and acrylonitrile-free acrylic resin dispersions, whose resin components consist of acrylic or methacrylic esters, a small share of hydroxyalkyl esters of unsaturated carbonic acids, and, under certain circumstances, small quantities of acrylic or methacrylic acid. Even though textile sheets so treated have a higher wet tensile strength than those whose binders do not contain the hydroxyalkyl ester components mentioned, their wet tensile strength leaves something to be desired.

European Pat. No. A 19 169 describes aqueous dispersions which are used as binders for fiber non woven. The binders consist of a mixed polymerizate of acrylic or methacrylic esters or other monomers, and 3–10% by weight of units of acrylamide-glycolic acid. These binders are therefore examples of binders which do not yield any formaldehyde when heated. Since, however, textile sheets treated with these binders do not exhibit the desired degree of wet tensile strength, small quantities of N-methylolacrylamide are polymerized into the mixed polymerizates, which causes on increase of the wet tensile strength of the treated fiber sheets. However, the potential for the release of formaldehyde appears again.

European Pat. No. A96 230 describes coating materials which, as cross-linking binders, contain mixed polymerizates of acrylic monomers and a cross-linking system of acrylamido glycolic acid methylester-methylether and hydroxy, carboxy or amido-functional comonomers. During heating, the monomer units of the system undergo condensation reactions. The use of such mixed polymerizates as binders for textile sheets is not known. A need therefore continues to exist for a method by which bound textile sheets can be manufactured which exhibit improved wet tensile strength and which do not release formaldehyde when heated.

SUMMARY OF THE INVENTION

Accordingly, one object of the present invention is to provide a binder for textile sheets which exhibits improved wet tensile strength and which does not release formaldehyde when heated.

Briefly, this object and other objects of the present invention as hereinafter will become more readily apparent can be obtained by a method of manufacturing bound textile sheets by treating a textile sheet substrate with a aqueous dispersion of a mixed polymerizate binder of: (a) 90–99% by wt. of a $C_{1-8}$ alkyl ester of acrylic acid, a $C_{1-8}$ alkyl ester of methacrylic acid, or combination thereof, or a mixture of at least one of said acrylate or methacrylate esters with styrene, (b) 1–10% by wt. of an acrylamide glycolic acid monomer of the formula:

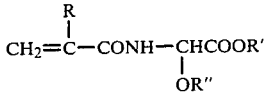

wherein R is hydrogen or methyl, R′ is alkyl and R″ is hydrogen or alkyl, and (c) 0–20% by wt. of another comonomer.

DETAILED DESCRIPTION OF THE PREFERRED EMBODIMENTS

The bound textile sheets of the present invention in comparison to known sheets which have been treated with formaldehyde-free binders, are characterized by a clearly increased wet tensile strength. Surprisingly, it has been found that a considerable improvement in the wet tensile strength can be achieved, if binders based on ether-esters of an acrylamide glycolic acid are used. The improved wet tensile strength is significant in cases where the bound textile sheet is subjected in the wet state to a mechanical load during manufacture, processing or usage. An example of such a case in which a bound textile sheet is subjected in the wet state to usage is in the manufacture of bound non woven fiber webs from synthetic fibers, especially polyester fibers, which are used for the manufacture of so-called disposable diapers. In this case, the bound fiber web forms the outer shell of the diaper, which encases a strongly-absorptive filling. Because of the low water absorptivity of the synthetic fiber, the outer shell appears relatively dry if the encased filling has absorbed considerable quantities of fluid. It is, however, of significant importance that the outer shell does not tear under mechanical load and thus expose the filling which is saturated with fluid.

The increased wet tensile strength of the bound textile sheets of the invention is based on acrylamido glycolic acid monomer units of the formula:

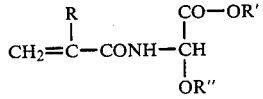

This monomer is a component of the mixed polymerizate present in the aqueous dispersion. R is hydrogen or methyl. R′ is alkyl and R″ is hydrogen or alkyl. Preferably, R″ is an alkyl group, R′ and R″ can be identical alkyl groups, particularly methyl groups. However, other alkyl groups, preferably alkyl groups of no more than 8 carbon atoms, may be used, particularly smaller alkyl groups of up to 4 carbon atoms.

The acrylic or methacrylic alkyl ester which forms the main body of the mixed polymerizate, or its mixture with styrene is selected in a manner which is per se familiar, so that the dynamic freezing point $T_{\lambda max}$ is not higher than 60°, preferably not higher than 20°. In a typical case, the mixed polymerizate consists, by up to 30–60% by weight, of monomer units which yield hard homopolymerizates such as methyl, ethyl, propyl, or isopropyl-methacrylate or styrene, and some 20–70% of acrylic acid esters of $C_{1-8}$ alkanols or methacrylic acid esters of $C_{4-8}$-alkanols.

Further unsaturated monomer components such as acrylic or metharylic acids can be employed, which, in quantities of about 1% by weight, improve the stability of the dispersion. Also, cross-linking comonomers such as glycolic dimethacrylate, allyl methacrylate, methylene-bis-methacrylamide and butanediol diacrylate can, in small quantities, improve the tensile strength properties of the binder. Excessive quantities of cross-linking material, however, hamper the film-forming process, and should therefore be avoided. In addition, acrylonitrile, methacrylonitrile, vinyl acetate, vinyl chloride, and the like are among the usable comonomers. Hydroxyesters and amides of acrylic or methacrylic acids are generally not present in the mixed polymerizates.

Acrylic resin dispersions can be manufactured by any well known procedure of emulsion polymerization. This dispersion can contain anionic, cationic or nonionic emulsifiers, or compatible mixtures thereof. Preferably, the dispersions are manufactured with a solids content of 50–70% by weight.

The procedure of the present invention is suitable for bonding and fixing textile sheets of all types which include fabrics, knits, battings and particularly nonwoven fiber webs. The present invention is not limited to certain types of fiber; however, synthetic fibers or fiber mixtures containing synthetic fiber are basically preferred. These mixtures can, for instance, contain 70% or more synthetic fiber. Suitable synthetic fibers which can be employed include regenerated cellulose fibers such as viscose filament or spun rayon, and especially fully synthetic fibers such as polyesters or polypropylene fibers. Preferred textile sheets consist of 70–100% by weight polyester fibers and 0–30% by weight spun rayon.

The formulation of a dispersion for fixing the fiber sheets is accomplished by the above described procedure and the requirements which the end product has to meet. The usual additives for this procedure which include wetting agents, antifoaming agents, thermosensitizer-softeners and smootheners, anti-static agents, anti-microbiotic agents, dyes, fillers, flame-retardants, perfumes, and the like, may be used. In general the dispersion is diluted with water to a binder content of 10–40% by weight. The viscosity of the diluted dispersion may reside in the range of 10–10,000 mPa.s. For the fixing of battings, e.g., of polyester, polyamide or polyacrylonitrile fibers, a liquid mixture of 15–25% is sprayed on the fiber sheet. Compact fiber webs and needle felts can easily be fixed upon impregnation with 10–40% dilutions, followed by squeezing fluid and drying. Light fiber webs can also be fixed by foam impregnation. For this purpose, foaming agents and foam stabilizers are added to 10–25% solids diluted dispersion, and foaming with air is performed up to a liter weight of 100–300 g. The foam impregnation of the light-fiber web is performed on horizontal foulard. Very light fiber web can be partially print bonded with pastes containing 20–40% binder and which have a viscosity of 4000–8000 mPa.s. Needle felt for high-quality floor and wall coverings are preferably slopped with thickened, sometimes foamed, mixtures. Finally, web bonding by coating is also possible.

Fixing of the fiber sheet can be accomplished by the application of between 5 and 100% binder, based on the weight of the fiber. The preferred binder content is between 10 and 30% by weight. The fiber sheets treated according to the procedure of the present invention only achieve their favorable utilization characteristics by being dried at temperatures greater than 110°, up to about 200°, preferably in the range of 120°–160° C.

If in addition it is desired that the fixed fiber sheet have resistance to organic solvents, then a cross-linking agent such as glyoxal can be added to the dispersion.

Having generally described this invention, a further understanding can be obtained by reference to certain specific examples which are provided herein for purposes of illustration only and are not intended to be limiting unless otherwise specified.

Preparation of Dispersion A

In a flask equipped with a stirrer, thermometer and reflux condenser, 40 parts by weight of completely deionized water are heated to 80° C. and mixed with 0.02 parts by weight of the sodium salt of a sulfated additive product of tri-isobutyl phenol and 7 moles of ethylene oxide, as well as 0.04 parts by weight of ammonium peroxydisulfate. To this mixture is added an emulsion consisting of 57 parts by weight of n-butyl acrylate, 39.5 parts by weight of methyl methacrylate, 3.5 parts by weight of acrylamido-methyl glycolate methyl ether, 61.5 parts by weight of completely deionized water, 1.5 parts by weight of the sodium salt of a sulfated additive product of triisobutyl phenol and 7 moles of ethylene oxide, and 0.25 parts by weight of ammonium peroxydisulfate gradually over the space of 4 hours. For the purpose of post-polymerization, the resulting product is maintained for another 2 hours at 80° C. A stabile, coagulate-free dispersion having a solids content of about 50% is obtained.

Preparation of a Control Dispersion B without Acrylamido-glycolic Acid Monomer Units Into a polymerization vessel equipped with a reflux condenser, stirrer rod and thermometer, is added an emulsion consisting of 44 parts by weight of methyl methacrylate, 56 parts by weight of n-butyl-acrylate, 61.5 parts by weight of completely deionized water, 1.5 parts by weight of the sodium salt of a sulfated additive product of tri-isobutyl phenol and 7 moles of ethylene oxide, and of 0.25 parts by weight of ammonium peroxydisulfate over the course of 4 hours, with stirring, to a solution warmed to 80° C. and consisting of 0.04 parts by weight of ammonium peroxydisulfate and 0.02 parts by weight orf the abovementioned emulsifiers in 40 parts by weight of completely deionized water. Subsequently, the temperature is maintained at 80° C. for an additional 2 hours. A stable, coagulate-free dispersion having a solids content of about 50% is obtained.

A thermally pre-fixed polyester web having a surface weight of approximately 18 g/m is impregnated with the synthetic resin dispersion diluted to about 25% dry matter, and excess dispersion is squeezed from the web with the foulard in such a way that a resin content of about 15% is obtained. The damp web is dried at 140° C. in a period of 5 minutes. The tensile strength of the non woven web is determined by the procedure of German Industrial Standard (DIN) 53 8578, Pt. 2 on dry fleece (F) and wet fleece ($F_n$) after a one-hour wait in water by means of a tensile testing machine as described in DIN 51 221.

In order to demonstrate the advantages of the present binder even on hydrophilic fiber sheets, a sheet of chromatography paper (#, Whatman) is impregnated in the same manner as indicated above for the polyester web. The resin content amounts to about 30%. The tensile strength is determined by the procedure described in DIN 53 112, PP. 1 and 2.

The tensile strength results obtained from the treated samples described above are shown in the following table. The values obtained represent mean values from 12 individual determinations.

Example 1 shows the results obtained with the use of dispersion A.

Example 2 is a control experiment in which control dispersion B was used, which is not prepared according to the methodology of the present invention.

Example 3 is a control experiment performed as described in German Pat. DE-OS No. 32,02,122.

| | Tensile Strength (N) | | | |
|---|---|---|---|---|
| | impregnated polyester web | | impregnated chromatography paper | |
| | F | Fn | F | Fn |
| Example 1 | | | | |
| 57 pts. butyl acrylate<br>39.5 pts. methyl methacrylate<br>3.5 pts. acrylamide methyl glycolate methyl ether | 106 | 103 | 70 | 46 |
| Example 2 | | | | |
| 56 pts. butyl acrylate<br>44 pts. methyl methacrylate | 98 | 88 | 60 | 24 |
| Example 3 | | | | |
| 55.5 pts. butyl acrylate<br>39 pts. methyl methacrylate<br>5 pts. hydroxy-ethyl-acrylate<br>0.5 pts. methacrylic acid | 108 | 94 | 66 | 35 |

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method for the manufacture of bound textile sheets, comprising:

treating a textile sheet substrate with an aqueous dispersion of a mixed polymerizate binder of:

(a) 80–99% by wt. of a $C_{1-8}$ alkyl ester of acrylic acid, a $C_{1-8}$ alkyl ester of methacrylic acid, or combination thereof, or a mixture of at least one of said acrylate or methacrylate esters with styrene, (b) 1–10% by wt. of an acrylamide glycolic acid monomer of the formula:

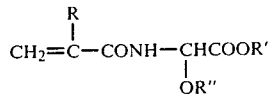

wherein R is hydrogen or methyl, R′ is alkyl and R″ is hydrogen or allkyl, and (c) 0–20% by wt. of another comonomer.

2. The method of claim 1, wherein said textile sheet substrate used is a fiber web.

3. The method of claim 2, wherein said fiber web consists at least primarily of synthetic fibers.

4. The method of claim 3, wherein said fiber web is formed at least in part from a synthetic fiber portion which consists of polyester fibers.

5. The method of claim 1, wherein said R″ substituent is alkyl.

6. The method of claim 5, wherein said textile sheet substrate is a fiber web.

7. The method of claim 6, wherein said fiber web consists entirely or largely of synthetic fibers.

8. The method of claim 7, wherein said fiber web is comprised of at least a portion of synthetic fibers which consist at least partially of polyester fibers.

9. A method for the manufacture of bound textile sheets, comprising:

treating a polyester, polyester containing spun rayon, or polypropylene textile sheet substrate with an aqueous dispersion of the mixed polymerizate binder of:

(a) 80–99% by weight of a $C_{1-8}$ alkyl ester of acrylic acid, a $C_{1-8}$ alkyl ester of methacrylic acid, or a combination thereof, or a mixture of at least one of said acrylate or methacrylate esters with styrene;

(b) 1–10% by weight of an acrylamide glycolic acid monomer of the formula:

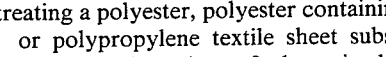

$CH_2{=}C(R)—CONH—CH(OR'')—COOR'$ wherein R is a hydrogen atom or a methyl group, R′ is an alkyl group and R″ is a hydrogen atom or an alkyl group; and (c) 0–20% by weight of another comonomer.

10. A bound textile sheet, comprising:

a binder impregnated textile sheet substrate, said binder being a mixed polymerizate of:

(a) 80–99% by weight of a $C_{1-8}$ alkyl ester of acrylic acid, a $C_{1-8}$ alkyl ester of methacrylic acid, or combination thereof, or a mixture of at least one of said acrylate or methacrylate esters with styrene, (b) 1–10% by weight of an acrylamide glycolic acid ester monomer of the formula:

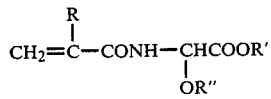

wherein R is hydrogen or methyl, R′ is alkyl and R″ is hydrogen or alkyl, and (c) 0–20% by weight of at least one comonomer.

11. The bound textile sheet of claim 10, wherein said bound textile sheet is a bound, nonwoven fiber web.

12. The bound textile sheet of claim 11, wherein the fiber portion of said textile sheet substrate consists entirely or largely of synthetic fibers.

13. The bound textile sheet of claim 12, wherein the synthetic fibers consists wholly or largely of polyester fibers.

14. The bound textile sheet of claim 12, wherein said bound textile sheet contains 10–40% by weight of the binder.

15. A bound textile sheet, comprising:

a binder impregnated textile sheet substrate, said binder being a mixed polymerizate of:

(a) 80–99% by weight of a $C_{1-8}$ alkyl ester of acrylic acid, a $C_{1-8}$ alkyl ester of methacrylic acid, or combination thereof, or a mixture of at least one of said acrylate or methacrylic esters with styrene, (b) 1–10% by weight of an acrylamide glycolic acid ester monomer of the formula:

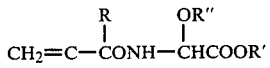

wherein R is hydrogen or methyl, R′ is alkyl and R″ is (c) 0–20% by weight of at least one comonomer.

16. The bound textile sheet of claim 15, wherein said textile sheet substrate is an nonwoven fiber web.

17. The bound textile sheet of claim 16, wherein the fiber portion of said fiber web consists largely or entirely of synthetic fibers.

18. The bound textile sheet of claim 17, wherein the synthetic fibers consists largely or wholly or polyester fibers.

19. The bound textile sheet of claim 17, wherein said bound textile sheet contains 10–40% by weight of the binder.

20. A bound textile sheet, comprising:

a binder impregnated polyester, polyester and spun rayon, or polypropylene textile sheet substrate, said binder being a mixed polymerizate of:

(a) 80–99% by weight of a $C_{1-8}$ alkyl ester of acrylic acid, a $C_{1-8}$ alkyl ester of methacrylic acid, or a combination thereof, or a mixture of at least one of said acrylate or methacrylate esters with styrene;

(b) 1–10% by weight of an acrylamide glycolic acid ester monomer of the formula:

wherein R is a hydrogen atom or a methyl group, R′ is an alkyl group and R″ is a hydrogen atom or an alkyl group; and (c) 0–20% by weight of at least one comonomer.

* * * * *